US006148468A

United States Patent [19]

Chen

[11] Patent Number: 6,148,468

[45] Date of Patent: Nov. 21, 2000

[54] LUMINOUS MATERIAL FOR BATHING SCRUBBERS

[76] Inventor: Kuo-Chin Chen, 2-1 Fl., No. 18, Alley 47, Lane 208, Jui An Street, TaAn District, Taipei, Taiwan

[21] Appl. No.: 09/159,823

[22] Filed: Sep. 23, 1998

[51] Int. Cl.[7] ..... A47K 7/02

[52] U.S. Cl. ..... 15/229.11; 15/209.1; 15/208; 428/365; 428/372

[58] Field of Search ..... 15/208, 210.1, 15/209.1, 229.11, 229.12, 229.14; 428/372, 365

[56] References Cited

U.S. PATENT DOCUMENTS

| | | |
|---|---|---|
| 4,781,647 | 11/1988 | Doane . |
| 5,321,069 | 6/1994 | Owens . |
| 5,784,747 | 7/1998 | Girardot et al. . |
| 5,914,076 | 6/1999 | Schloss . |

FOREIGN PATENT DOCUMENTS

| | | |
|---|---|---|
| 8323926A | 12/1996 | Japan . |
| 9067764A | 3/1997 | Japan . |
| 9111678A | 4/1997 | Japan . |
| 9228149A | 9/1997 | Japan . |
| 2085465 | 4/1982 | United Kingdom . |

*Primary Examiner*—Deborah Jones
*Assistant Examiner*—Jennifer McNeil
*Attorney, Agent, or Firm*—Pro-Techtor International Services

[57] ABSTRACT

Disclosed is a luminous material formed from artificial fibers containing luminous powder for making bathing scrubbers. The artificial fibers are compressed into wide and long strips that are suitable for forming into artificial fiber ring members. A plurality of such ring members can be densely tied together to form a ball-shaped bathing scrubber or be braided together to form a long braid-shaped bathing scrubber. The luminous powder is blended into raw material of artificial fibers during manufacture of the fibers to give the artificial fibers a luminous surface with suitable roughness and friction. Therefore, bathing scrubbers made with the artificial fibers containing luminous powder not only give out bright and attractive light but also thoroughly remove dust and callus from a user's skin.

3 Claims, 4 Drawing Sheets

LUMINOUS MATERIAL FOR BATHING SCRUBBERS

BACKGROUND OF THE INVENTION

The present invention relates to a luminous material for making bathing scrubbers, and more particularly to a kind of artificial fiber having adequate amount of luminous powder blended thereinto during the manufacture process thereof, so that the artificial fiber is luminous and has suitably rough surface. When the artificial fibers are compressed into strips for making differently shaped bathing scrubbers, the scrubbers are attractive and effective in removing dust and callus from a user's skin.

There are many bathing scrubbers made of multi-layers of artificial fibers folded and tied together, such as ball-shaped and long braid-shaped bathing scrubbers. Such bathing scrubbers made of artificial fibers tend to produce and hold large quantity of bubbles and are therefore soft and comfortable for use.

When manufacturing conventional artificial fibers for making bathing scrubbers, pigments are usually blended into raw material of artificial fibers. There are almost unlimited colors that can be presented on the artificial fibers. These colors, however, do not give the artificial fibers bright and luminous surface. That is, most bathing scrubbers made of artificial fibers look dull, even though they are colored. Maybe light colors can make the bathing scrubbers look brighter, but they do not make the scrubbers shining and lively. Such bathing scrubbers are therefore less attractive and not so competitive in the markets.

Moreover, such conventional artificial fibers have smooth surface that is soft and comfortable in touch. However, such smooth surface is not suitable for thoroughly removing dust and callus from the user's skin.

Therefore, it is desirable to develop a type of luminous artificial fiber having suitably rough surface, so that bathing scrubbers made with such artificial fibers have luminous appearance to attract consumers and increase their share in markets and have rough surface to comfortably and effectively clean a user's body.

SUMMARY OF THE INVENTION

It is therefore a primary object of the present invention to provide a type of luminous artificial fiber for making bathing scrubbers, so that the produced bathing scrubbers look brightly attractive in appearance.

Another object of the present invention is to provide a type of artificial fibers having suitably rough surface for making bathing scrubbers, so that the produced bathing scrubbers are effective in removing dust and callus from a user's skin.

To achieve the above and other objects of the present invention, luminous powder is blended into raw material for manufacturing the artificial fibers during the process of forming the artificial fibers, so that the luminous power is evenly distributed in and over the artificial fibers to make the latter luminous. The produced luminous artificial fibers are compressed into wide long strips that can be rolled and folded into ring-shaped artificial fiber members. These ring-shaped members may be densely tied together at two diametrically opposite points to form a ball-shaped bathing scrubber. Or, these ring-shaped members may be braided into a long chain-shaped bathing scrubber. These bathing scrubbers have pleasant luminous appearance and comfortably rough surface to effectively remove dust and callus from the skin.

BRIEF DESCRIPTION OF THE DRAWINGS

The above and other objects and the features and effects of the present invention can be best understood by referring to the following detailed description of the preferred embodiments and the accompanying drawings, wherein.

DETAILED DESCRIPTION OF THE PREFERRED EMBODIMENTS

Figure 1:
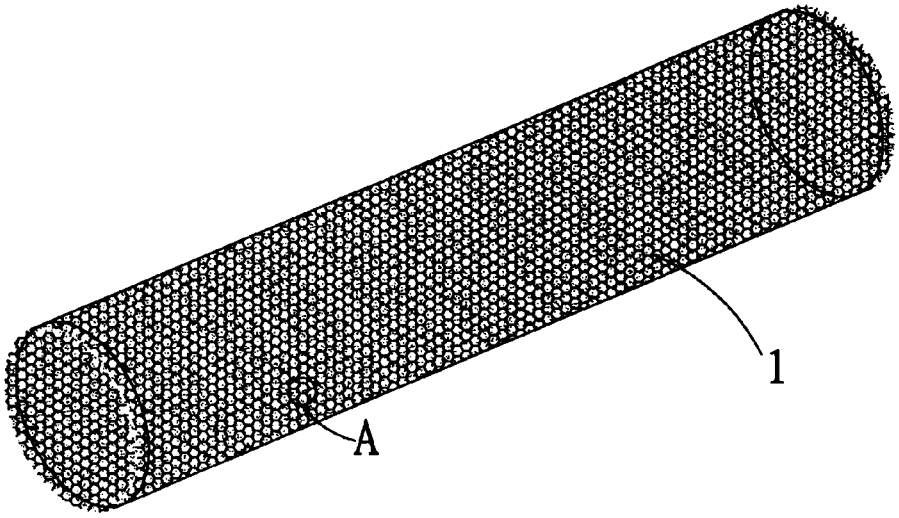
FIG. 1 is a perspective showing a roll of luminous artificial fibers of the present invention for forming differently shaped bathing scrubbers.
Figure 2:
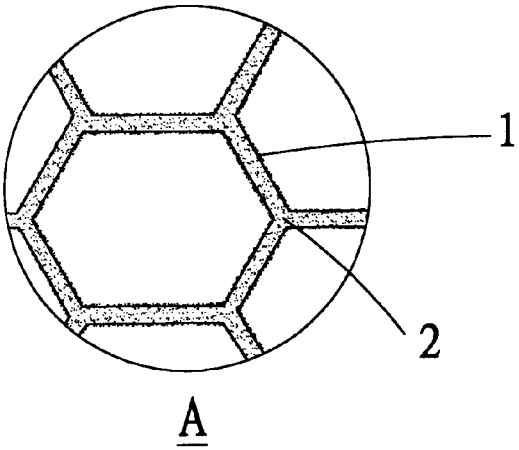
FIG. 2 is a fragmentary, enlarged view of FIG. 1 showing texture of the artificial fibers in details.
Figure 3:
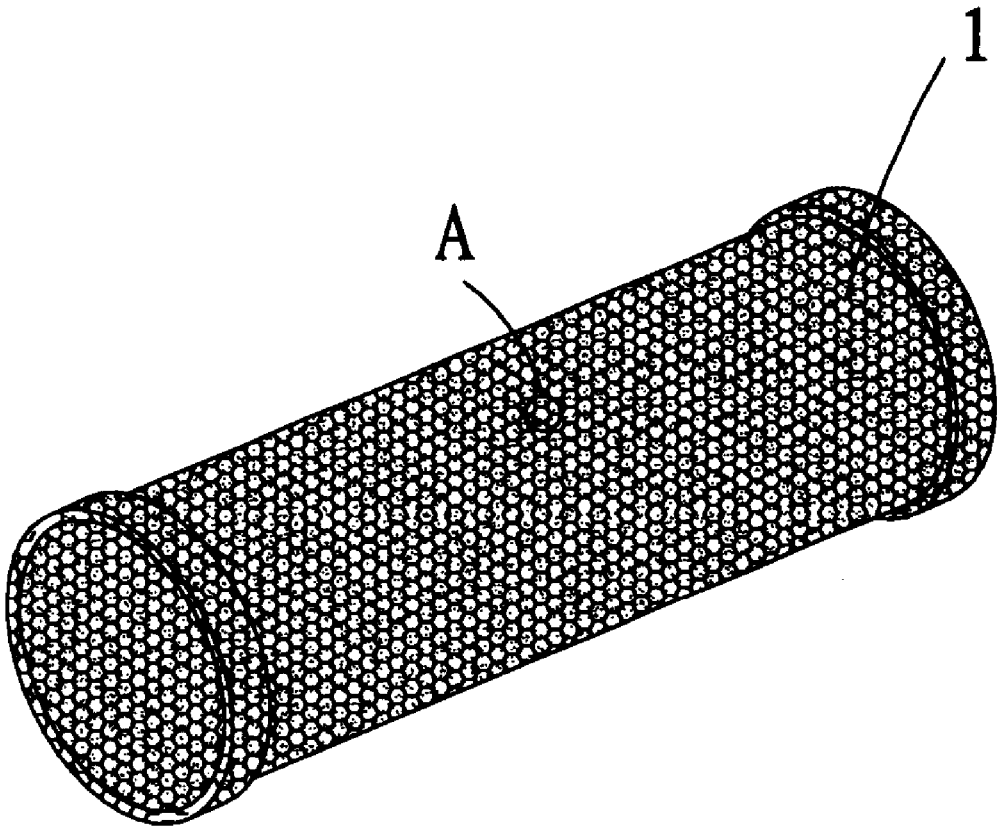
FIG. 3 illustrates the manner to form an artificial fiber ring member from the roll of artificial fibers of FIG. 1.

Please refer to FIG. 1 that is a perspective view of a roll of luminous artificial fibers 1 provided according to the present invention and FIG. 2 that is a fragmentary enlarged view of FIG. 1 showing detailed texture of the artificial fibers 1 of the present invention. To form these luminous artificial fibers 1, adequate amount of luminous powder 2 is blended into raw material for manufacturing artificial fibers 1 during the course of manufacture. The produced artificial fibers 1 are then compressed into long strip with suitable width. The luminous powder 2 blended into the raw material will evenly distribute inside and over the produced artificial fibers 1, making the artificial fibers 1 luminous and have a surface with suitable roughness to provide adequate friction that is sufficient for thoroughly removing dust and/or callus from a human body skin. The wide and long strip of artificial fibers 1 is then rolled into a cylindrical shape as shown in FIG. 1. The cylindrical-shaped artificial fiber roll is further folded into a whole bundle of luminous artificial fibers 1. When the artificial fibers 1 are in the cylindrical shape of FIG. 1, two ends thereof can be turned inward as shown in FIG. 3, so that an artificial fiber ring member can finally be formed.

Figure 4:
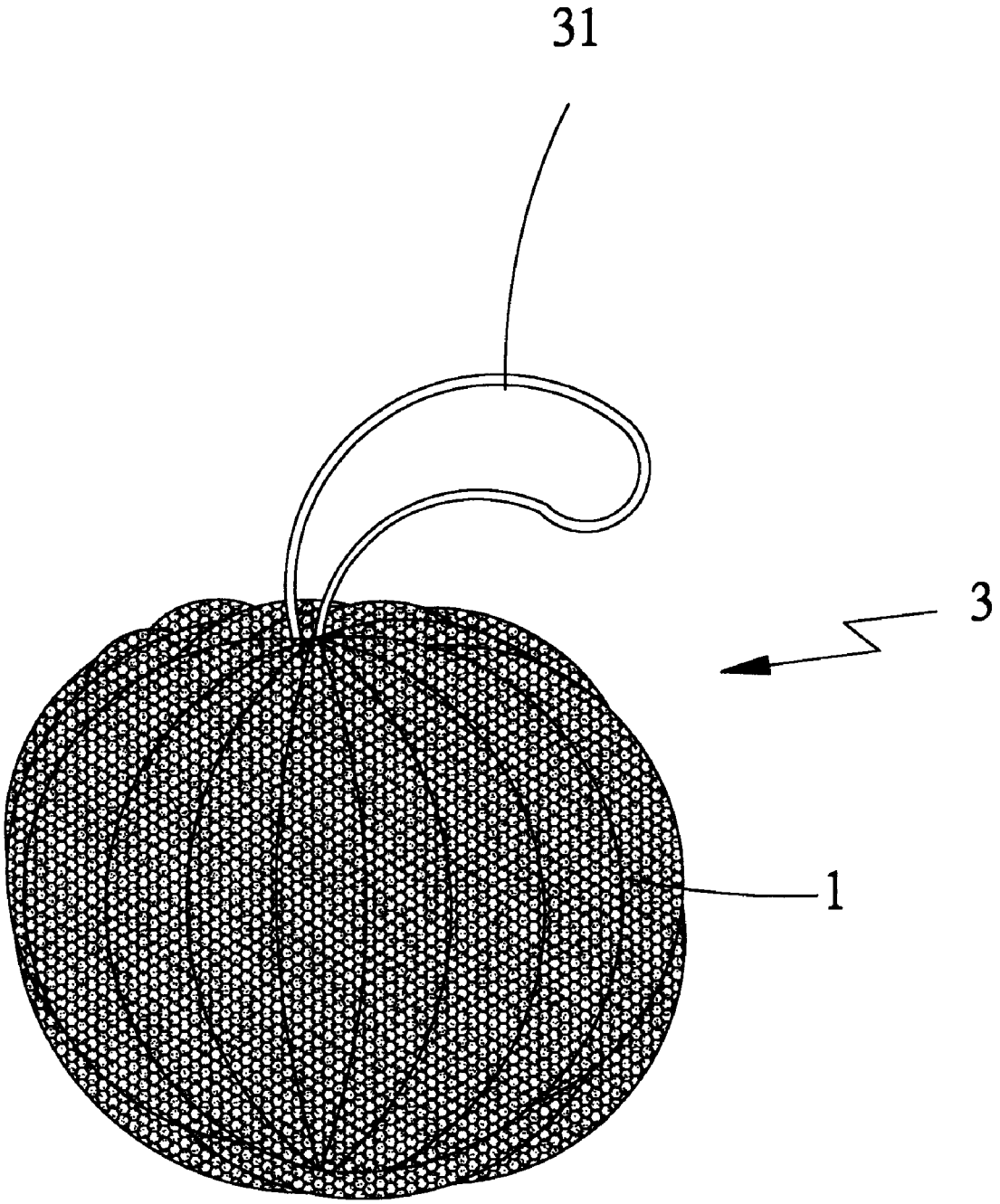
FIG. 4 shows a ball-shaped bathing scrubber formed from the luminous artificial fiber ring members according to the present invention.

With multiple artificial fiber ring members formed in the above manner, various kinds of bathing scrubbers can be made. Please now refer to FIG. 4 in which a ball-shaped bathing scrubber 3 made with the luminous artificial fibers 1 of the present invention is shown. The ball-shaped bathing scrubber 3 is formed by densely tying a plurality of the artificial fiber ring members of the present invention together with strings threading through two diametrically opposite ends of these ring members. A loop 31 may be provided at one end of the ball-shaped bathing scrubber 3 for conveniently hanging the bathing scrubber 3 to somewhere when it is not in use. Due to the luminous powder evenly distributed in and over the artificial fibers 1, the ball-shaped bathing scrubber 3 gives out bright and attractive light. Meanwhile, the suitably rough surface of the artificial fibers 1 resulted from the luminous powder 2 allows the ball-shaped bathing scrubber 3 to comfortably frictionally contact a user's skin and to thoroughly remove dust and callus from the skin.

Figure 5:
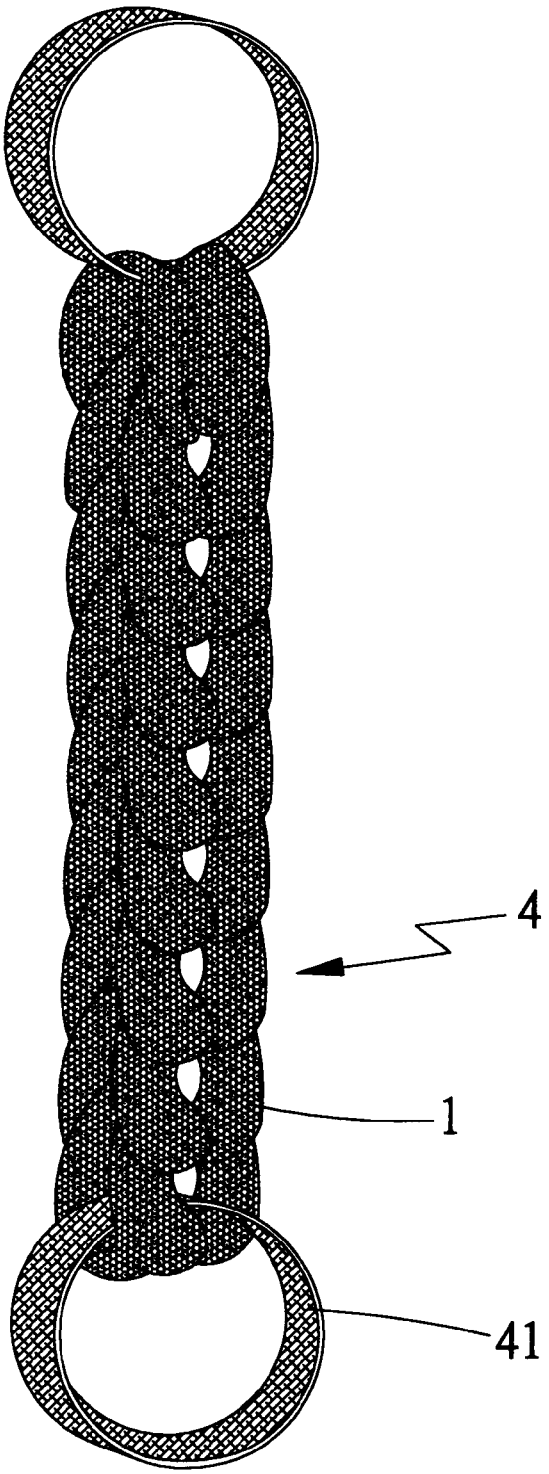
FIG. 5 shows a long braid-shaped bathing scrubber formed from the luminous artificial fiber ring members according to the present invention.

FIG. 5 illustrates a braid-shaped long bathing scrubber 4 formed by braiding artificial fiber ring members of the present invention in different manners. Two loops 41 may be connected to two ends of the braid-shaped bathing scrubber 4 for easy grip by a user or conveniently hanging to a certain place when the bathing scrubber 4 is not in use. Just like the ball-shaped bathing scrubber 3, the braid-shaped long bathing scrubber 4 gives out bright and attractive light and provides proper roughness for thoroughly removing dust and callus due to the luminous powder 2 contained in and distributed over the artificial fibers 1.

The luminous artificial fibers 1 of the present invention is a novel product and has the effect of giving out bright and attractive light. Moreover, the luminous powder 2 contained in the artificial fibers 1 gives the latter a surface with suitable roughness and friction that allows bathing scrubbers, such as the above described ball-shaped and braid-shaped bathing scrubbers, to effectively remove dust and callus from the user's skin. The luminous artificial fibers of present invention are therefore novel and practical for use.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A luminous bathing scrubber comprising:

a plurality of artificial fibers, said artificial fibers having luminous powder applied to said artificial fibers during a manufacturing process such that said artificial fibers have a rough surface; said artificial fibers with said luminous powder applied thereto are compressed into wide and long strips and are formed into geometric members, wherein a plurality of said geometric members are densely tied together forming a bathing scrubber.

2. A luminous bathing scrubber of claim 1 wherein:

a plurality of said geometric members are tied together at two diametrically opposite points to form a ball-shaped bathing scrubber.

3. A luminous bathing scrubber of claim 1 wherein:

a plurality of said geometric members are braided together to form an elongated braid-shaped bathing scrubber.

* * * * *